US008907619B2

(12) United States Patent
Shukuya et al.

(10) Patent No.: US 8,907,619 B2
(45) Date of Patent: Dec. 9, 2014

(54) WIRELESS CHARGER INSTALLED WITH A TWO-DIMENSIONAL MOVING MECHANISM

(75) Inventors: Rei Shukuya, Tokyo (JP); Takashi Yamanaka, Tokyo (JP)

(73) Assignee: Tanashin Denki Co., Ltd., Tokyo (JP)

( * ) Notice: Subject to any disclaimer, the term of this patent is extended or adjusted under 35 U.S.C. 154(b) by 441 days.

(21) Appl. No.: 13/333,428

(22) Filed: Dec. 21, 2011

(65) Prior Publication Data

US 2012/0146579 A1 Jun. 14, 2012

Related U.S. Application Data

(63) Continuation of application No. PCT/JP2010/003967, filed on Jun. 15, 2010.

(30) Foreign Application Priority Data

Jun. 25, 2009 (JP) ..... 2009-150406

(51) Int. Cl.
*G12B 5/00* (2006.01)

(52) U.S. Cl.
CPC ..... *G12B 5/00* (2013.01)
USPC ..... 320/108; 74/490.09

(58) Field of Classification Search
CPC ..... H02J 7/025; B21D 28/20; B21D 28/26; B21D 28/265; B23Q 1/621
USPC ..... 320/108; 414/331; 74/29
See application file for complete search history.

(56) References Cited

U.S. PATENT DOCUMENTS

| | | | | |
|---|---|---|---|---|
| 5,311,791 | A * | 5/1994 | Yanagisawa | 74/490.09 |
| 5,497,060 | A * | 3/1996 | Juergens, III | 700/60 |
| 6,327,929 | B1 * | 12/2001 | Yanagisawa | 74/490.09 |
| 7,388,730 | B2 * | 6/2008 | Hori | 360/92.1 |
| 2008/0121010 | A1 * | 5/2008 | Battheu et al. | 72/422 |
| 2009/0079269 | A1 * | 3/2009 | Jin | 307/104 |
| 2009/0079387 | A1 * | 3/2009 | Jin et al. | 320/108 |
| 2009/0153098 | A1 * | 6/2009 | Toya et al. | 320/108 |
| 2010/0213894 | A1 * | 8/2010 | Sip et al. | 320/108 |
| 2011/0074344 | A1 * | 3/2011 | Park et al. | 320/108 |

FOREIGN PATENT DOCUMENTS

| | | | |
|---|---|---|---|
| CN | 101200040 | A | 6/2008 |
| CN | 101425703 | A | 5/2009 |
| JP | 62-5419 | A | 1/1987 |

(Continued)

OTHER PUBLICATIONS

International Search Report issued in PCT/JP2010/003967 dated Aug. 17, 2010.

(Continued)

*Primary Examiner* — Samuel Berhanu
*Assistant Examiner* — Jerry D Robbins
(74) *Attorney, Agent, or Firm* — Lowe Hauptman & Ham, LLP

(57) ABSTRACT

A wireless charger installed with a two-dimensional moving mechanism which is simply configured, inexpensive and can be easily miniaturized is provided wherein a table is freely moved in the X-axis direction and the Y-axis direction. In the two dimensional moving mechanism, each pair of X axis pinions are arranged to simultaneously mesh with teeth near both ends of each rack arranged on an X axis slider and Y axis slider respectively. Each pair of pinions are driven by each motor and rotated in synchronization.

5 Claims, 5 Drawing Sheets

(56) References Cited

FOREIGN PATENT DOCUMENTS

| | | | |
|---|---|---|---|
| JP | 5-92376 | A | 4/1993 |
| JP | 10-279045 | A | 10/1998 |
| JP | 2000-258572 | A | 9/2000 |
| JP | 2008-109762 | A | 5/2008 |
| JP | 2008-126404 | A | 6/2008 |
| JP | 2009-81945 | A | 4/2009 |

OTHER PUBLICATIONS

Office Action issued by JPO dated Feb. 18, 2014 of corresponding Japanese application No. 2011-519553.
Office Action issued by SIPO dated Dec. 4, 2013 of corresponding Chinese application.
Office Action issued by SIPO dated Jul. 14, 2014 of corresponding Chinese application No. 201080026583.5.

* cited by examiner

WIRELESS CHARGER INSTALLED WITH A TWO-DIMENSIONAL MOVING MECHANISM

CROSS-REFERENCE TO RELATED APPLICATIONS

This application is based upon and claims the benefit of priority from the prior Japanese Patent Application No. 2009-150406, filed on Jun. 25, 2009 and prior International Application No. PCT/JP2010/003967, the entire contents of which are incorporated herein by reference.

FIELD

The present invention is related to a wireless charger installed with a two-dimensional moving mechanism which is simply configured, inexpensive and can be easily miniaturized, wherein a table attached with a coil is freely moved in the X-axis direction and the Y-axis direction and power is transferred from the coil to the charger.

BACKGROUND

Various devices are proposed as a two-dimensional moving mechanism which freely moves a table in an X-axis direction and a Y-axis direction.

For example, the following two-dimensional moving device such is proposed as in Japanese Laid Open Patent H5-92376. In the Laid Open Patent, a two-dimensional moving mechanism is disclosed arranged with each pair of X-axis guides (14*a*, 14*b*) and X axis-racks (12*a*, 12*b*), each pair of Y-axis guides (26*a*, 26*b*) and Y axis-racks (24*a*, 24*b*), an X axis slider guide (30) movable in the Y axis direction along the Y axis guides and having pinion gears (33*a*, 33*b*) arranged across the Y axis guides and which mesh with each rack (24*a*, 24*b*) on both ends and a ball screw (34) parallel with this, an Y axis slider guide (18) movable in the X axis direction along the X axis guides having pinion gears (22*a*, 22*b*) arranged across the X axis guides and which mesh with each rack (12*a*, 12*b*) on both ends and a ball screw (38) parallel with this, a slider (42) movable in a X-Y direction on the X axis slider guide and Y axis slider guide and threaded to the ball screws (34, 38), and motors (38, 40) which rotationally drive the ball screws (34, 38) and move the sliders in the X-Y direction.

However, in this type of structure, miniaturization is difficult because a rack or ball screw must be arranged having a length equivalent to the distance which is moved by a slider in the X axis direction and Y axis direction. There is no description with regards to the material of a rack or ball screw in this Laid Open Patent, however it is usual to form a rack using a synthetic resin. A rack manufactured from a synthetic resin becomes more difficult to mold the longer it is, and component costs also increase. In addition, a ball screw is usually manufactured by cutting a metal round rod, however, a long ball screw is extremely expensive which is a problem.

In addition, a two dimensional moving device without using a rack disclosed in Japanese Laid Open Patent 2008-109762 is formed so that an X axis drive base (15) is meshed to a feed screw axis (12), the feed screw axis (12) is rotationally driven by an X motor (14) and the X axis drive base (15) is moved in an X axis direction, and a Y axis drive base (18) is meshed to a feed screw axis (16) which is attached to the X axis drive base (15), the feed screw axis (16) is rotationally driven by a Y motor (19) and the Y axis drive base (18) is moved in the Y axis direction.

However, in this type of structure too, miniaturization is difficult because a feed screw axis must be arranged having a length equivalent to the moving distance of the X axis drive base in the X axis direction and Y axis drive base in the Y axis direction. In addition, there is no description with regards to the material of the feed screw in this Laid Open Patent, however it is usual to manufacture this type of feed screw axis by cutting a metal round rod and shaping it as stated above and a long feed screw axis is extremely expensive which is a problem.

SUMMARY

Thus, the present invention aims to provide a wireless charger installed with a two dimensional moving mechanism which can be easily miniaturized and can be cheaply manufactured with a simple structure.

The present invention includes a wireless charger installed with a two-dimensional moving mechanism which includes a coil attached within a lower case, and an upper covering from above the lower case. When a charge battery attached with a coil is set on a top surface of the upper case, the coil is moved near to the charge battery by the two dimensional moving mechanism and the charge battery is charged by supplying power from the coil towards the charge battery. The two-dimensional moving mechanism includes a first drive mechanism including an X axis motor which moves an X axis slider in an X axis direction along an X axis guide, a second drive mechanism including a Y axis motor which moves a Y axis slider in a Y axis direction along a Y axis guide, and a table which moves in an X axis direction and a Y axis direction by the movement of the X axis slider and the Y axis slider. The X axis slider is integrally formed by a rack parallel to the X axis guide and an extension part parallel to the Y axis. The Y axis slider is integrally formed by a rack parallel to the Y axis guide and an extension part parallel to the X axis. The table includes a slider base attached to the X axis slider and the Y axis slider, and which moves in the X axis direction along the Y axis slider when the X axis slider moves in the X axis direction, and moves in the Y axis direction along the X axis slider when the Y axis slider moves in the Y axis direction, a table body fixed to the slider base, and the coil attached to the top surface of the table body. The first drive mechanism includes a pair of X axis pinions arranged at a location to simultaneously mesh with teeth near both ends of a rack of the X axis slider, and are driven by the X axis motor and rotated in synchronization when the X axis slider is located at the center of a moving range. The second drive mechanism includes a pair of Y axis pinions arranged at a location to simultaneously mesh with teeth near both ends of a rack of the Y axis slider, and are driven by the Y axis motor and rotated in synchronization when the Y axis slider is located at the center of a moving range.

Each of the pinions may be formed by a two stage gear and power of each of the motors may be transferred to each of the pinions by meshing each pair of first stage gears to the rack and via a worm gear which includes a first worm and a second worm which mesh with each pair of second stage gears respectively.

In the wireless charge installed with a two dimensional moving mechanism of the present invention, the rack moves and is passed from one pinion to the other pinion by meshing each pair of the pinions to each rack formed integrally with an X axis slider and Y axis slider respectively and rotating each pair of the pinions in synchronization. Therefore, it is possible to reduce the length of each rack to half the length of the maximum moving distance of the X axis slider and Y axis slider. As a result, it becomes easier to mold the sliders even in the case where they are manufactured from a synthetic resin, it is possible reduce component costs and therefore cheaply manufacture the mechanism itself. Furthermore, it is possible to miniaturize the mechanism itself by shortening each rack.

In addition, by forming each of the pinions with a two stage gear and meshing a first worm and second worm of each worm gear with the second stage gear respectively, it is possible to perform a screw thread process just on the part which meshes with each pinion as a worm gear, shorten the screw compared to a conventional feed screw, and significantly reduce manufacturing costs.

DESCRIPTION OF EMBODIMENT

Figure 1:
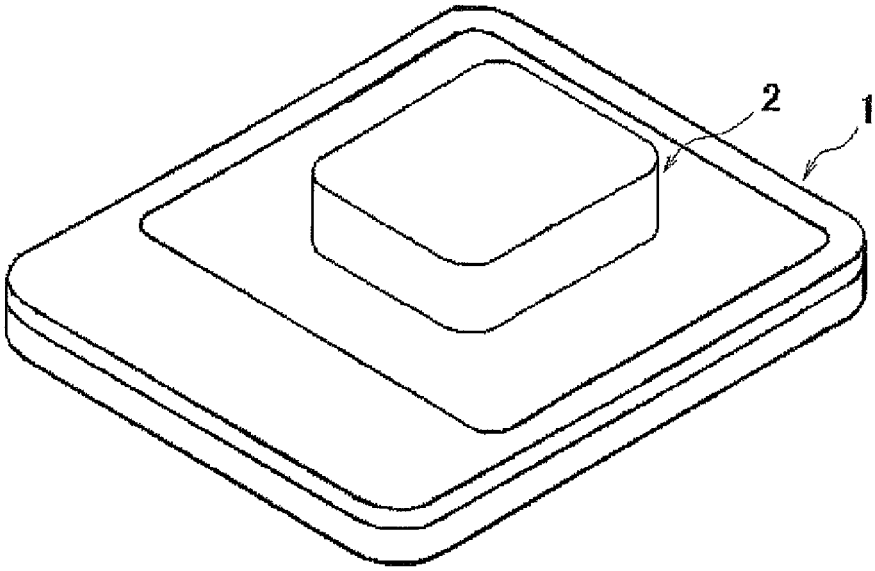
FIG. 1 is an external appearance perspective diagram of a wireless charger installed with a two dimensional moving mechanism of the present invention.

The preferred embodiments for realizing the present invention are explained while referring to the diagrams. FIG. 1 is a perspective view diagram which shows an external appearance of a wireless type charger 1 installed with a two dimensional moving mechanism and a charge battery 2 for an electronic device.

This wireless type charger 1 charges the charge battery 2 by wirelessly transferring the power of the charger 1 is to the charge battery 2 by simply placing the charge battery 2 on the upper surface of the charger 1 as is shown in FIG. 1 without the need to connect a charger with a charge battery via a connector etc. There are various methods of transferring power from a charger to a charge battery. In the present embodiment, while described in detail below, a coil is arranged on the charger and the charge battery respectively, the power of the charger is transferred by electromagnetic effects using these coils and charges the charge battery. However, charging methods are not limited to this.

Figure 2:
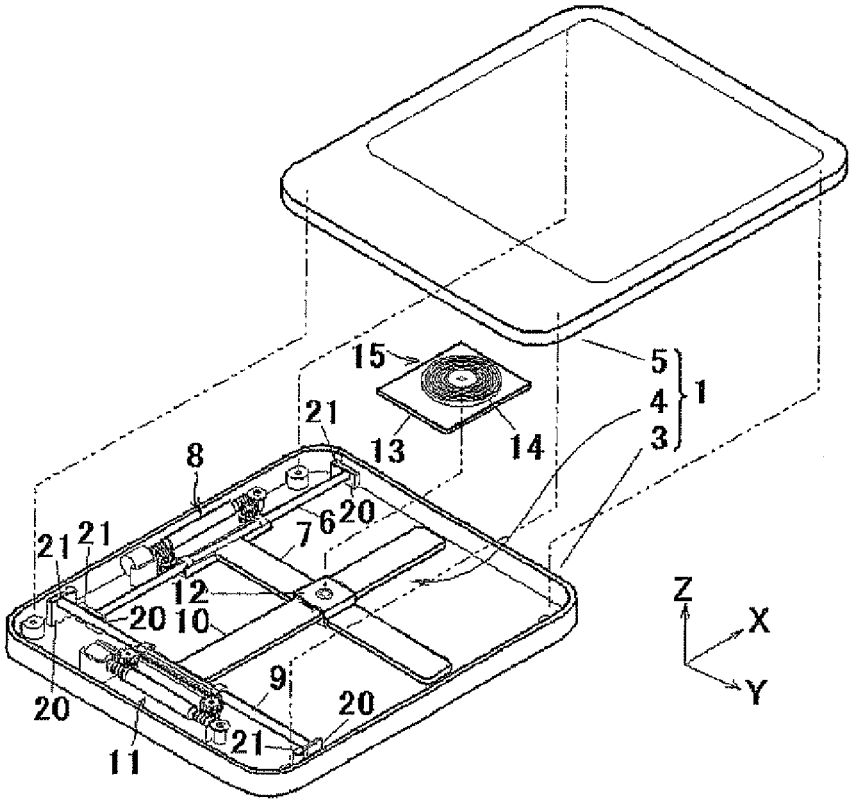
FIG. 2 is an exploded perspective view of the charger.

As shown in FIG. 2, the charger 1 is formed by arranging a two dimensional moving mechanism 4 within a lower case 3 formed from four sides of a rectangle with a thin wall pointing upwards, covering this from above with an upper case 5 and the lower case 3 and upper case 5 are fixed with a screw not shown in the diagram.

The arrows in the diagram show each axis direction, X shows the X axis direction, Y shows the Y axis direction and Z shows the Z axis direction. The two dimensional moving mechanism 4 is formed by an X axis guide 6 arranged parallel to the X axis direction, an X axis slider 7 which is guided by the X axis guide 6, a first drive mechanism 8 which moves the X axis slider 7, a Y axis guide 9 arranged parallel to the Y axis direction, a Y axis slider 10 which is guided by the Y axis guide 9, a second drive mechanism 11 which moves the Y axis slider 10, a slider base 12 which is attached to both the X axis slider 7 and the Y axis slider 10, and a table body 13 attached on the top of the slider base 12. A coil 14 is attached on the upper surface of the table body 13. A table 15 is formed by the table body 13, a coil 14 and the slider base 12.

The X axis guide 6 and the Y axis guide 9 are metal round rods. Both end parts of each are inserted from above to depression shaped axis attachment parts 20, 20 arranged on the lower case 3 and are prevented from being extracted from each axis attachment part 20, 20 by axis attachment guards 21, 21.

Figure 3:
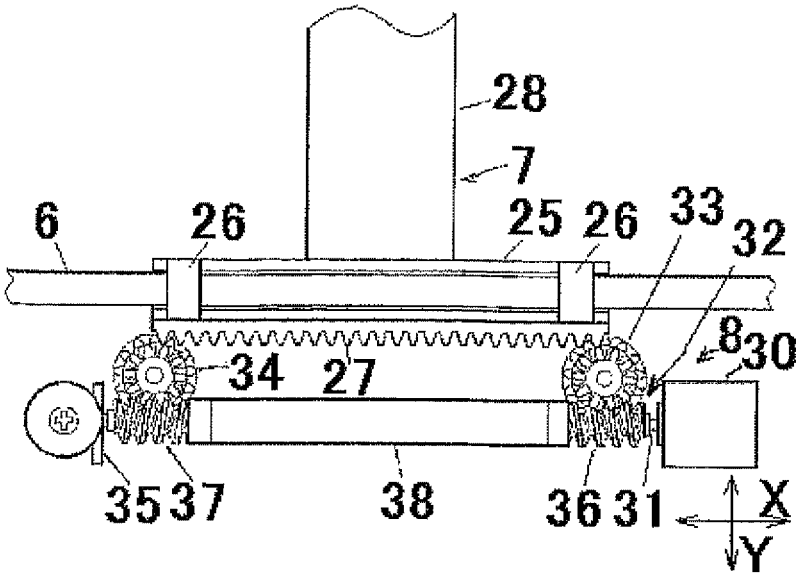
FIG. 3 is a planar diagram which shows the relationship between a slider for an X axis, and a pair of pinions and a worm gear.

FIG. 3 shows the state where the X axis slider 7 is located exactly in the center of the moving range of the X axis direction. The X axis slider 7 includes a pair of guide parts 26, 26 for attaching to the X axis guide 6 on both end parts of a long base part 25 in the X axis direction, and a rack 27 parallel to the X axis guide 6 at the bottom edge of the base part 25 in the diagram. The rack 27 has half the length of the maximum moving distance of the X axis slider 7. In addition, the base part 25 has an extension part 28 which extends in the Y axis direction from the center of the top edge in the diagram.

The first drive mechanism 8 is formed by an X axis motor 30, a worm gear 32 directly connected to an axis 31 of the motor 30, and a pair of X axis pinions 33, 34 which lie between the worm gear 32 and the rack 27. The pair of X axis pinions 33, 34 mesh simultaneously with teeth near both ends of the rack 27 in a state where the X axis slider 7 is located exactly at the center of a moving range in the X axis direction. Furthermore, the shape and dimensions of the pair of pinions 33, 34 are the same in the present embodiment, and while commonality of the components is aimed for, the shape and dimensions can be different according to design. The Y axis pinions 53, 54 described later are the same.

The worm gear 32 is arranged parallel to the X axis guide 6, and the end part on the opposite side to the X axis motor 30 is supported rotationally by an axis support part 35 arranged on the lower case 3. The worm gear 32 includes a first worm 36 and second worm 37 and the space between both worms 36, 37 form a linking part 38.

Figure 4:
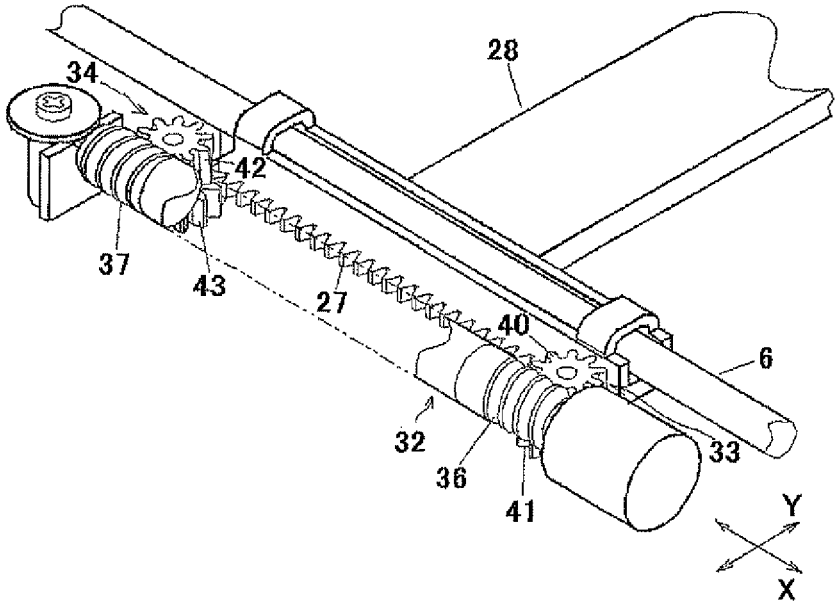
FIG. 4 is a perspective diagram which shows the relationship between a slider for an X axis, and a pair of the pinions and the worm gear.

As is shown in FIG. 4, the X axis pinions 33, 34 include a 2 stage gear which is composed of upper and lower gears. The lower first stage gears 41, 43 are spur gears which mesh with the rack 27 and the upper second stage gears 40, 42 are helical gears which mesh with the first worm 36 and second worm 37 respectively.

Figure 5:
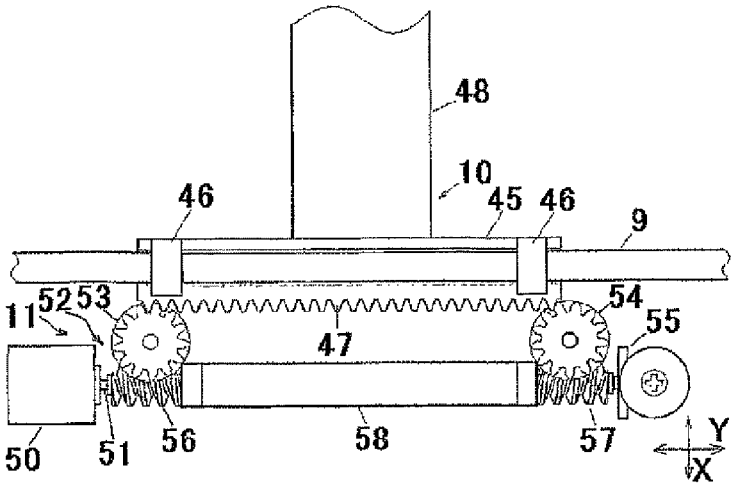
FIG. 5 is a planar diagram which shows the relationship between a slider for an Y axis, and a pair of pinions and a worm gear.

FIG. 5 shows a state where the Y axis slider 10 is located exactly at the center of a moving range in the Y axis direction. The Y axis slider 10 includes a pair of guide parts 46, 46 for attaching to the Y axis guide 9 on both end parts of a long base part 45 in the Y axis direction, and a rack 47 parallel to the Y axis guide 9 at the bottom edge of the base part 45 in the diagram. The rack 47 has half the length of the maximum moving distance of the Y axis slider 10. In addition, the base part 45 has an extension part 48 which extends in the X axis direction from the center of the top edge in the diagram.

The second drive mechanism 11 is formed by a Y axis motor 50, a worm gear 52 directly connected to an axis 51 of the motor 50, and a pair of Y axis pinions 53, 54 which lie between the worm gear 52 and the rack 47. The pair of Y axis pinions 53, 54 mesh simultaneously with teeth near both ends of the rack 47 in a state where the Y axis slider 10 is located exactly at the center of a moving range in the Y axis direction.

The worm gear 52 is arranged parallel to the Y axis guide 9, and the end part on the opposite side to the Y axis motor 50 is supported rotationally by an axis support part 55 arranged on the lower case 3. The worm gear 52 includes a first worm 56 and second worm 57 and the space between both worms 56, 57 form a linking part 58.

Figure 6:
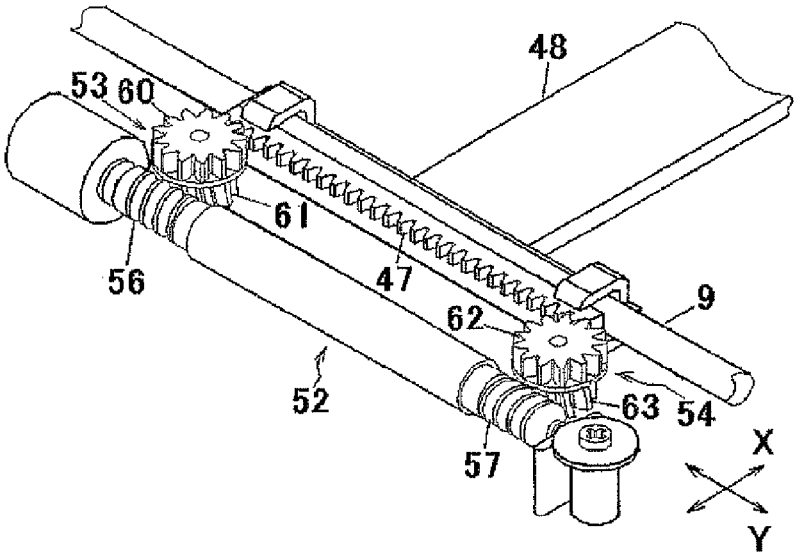
FIG. 6 is a perspective diagram which shows the relationship between a slider for an Y axis, and a pair of the pinions and the worm gear.

As is shown in FIG. 6, the Y axis pinions 53, 54 include a 2 stage gear which is composed of upper and lower gears. The upper first stage gears 60, 62 are spur gears which mesh with the rack 47 and the lower second stage gears 61, 63 are helical gears which mesh with the first worm 56 and second worm 57 respectively.

Figure 7:
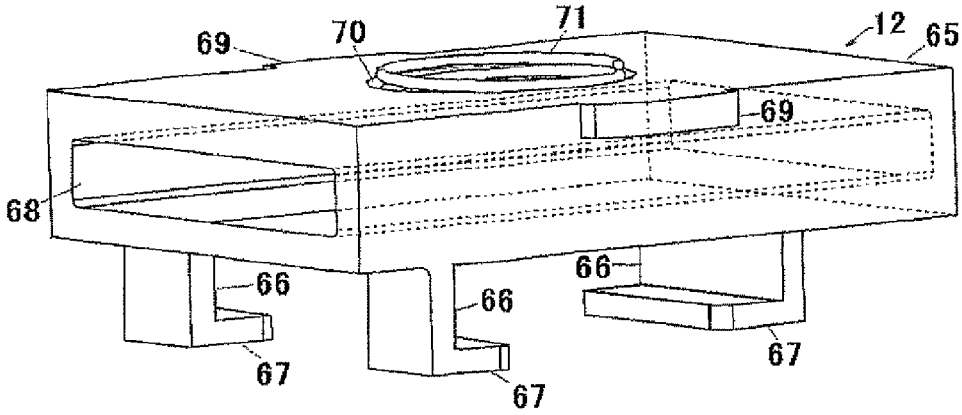
FIG. 7 is a perspective view of a slider base.

FIG. 7 is a perspective view diagram of the slider base 12. The slider base 12 includes L shaped leg parts 66 arranged on three places on a bottom surface of a rectangular tube part 65 which forms a rectangular shape. The L shaped leg parts 66 project from the rectangular tube part 65. That is, two leg parts 66 are arranged on the left side of the diagram with a curved part 67 of a lower end pointing to the right, and one leg part 66 is on the right side of the diagram with a curved part 67 of a lower end pointing to the left.

The rectangular tube part 65 includes guard parts 69, 69 which project from the rectangular tube part 65 as shown the upper parts of a front surface and rear surface in the diagram respectively, a round hole 70 having a bottom arranged on the ceiling surface and a compression spring 71 is housed within the round hole 70. The upper end of the compressing spring projects from the upper surface of rectangular tube part 65.

As is shown in FIG. 2, the slider base 12 is attached as follows with respect the extension part 28 of the X axis slider 7 and the extension part 48 of the Y axis slider 10. That is, the rectangular tube part 65 is slidably attached to the extension part 48 of the Y axis slider 10 and the three leg parts 66 are slidably attached to the extension part 28 of the X axis slider 7. In this way, the slider base 12 moves in the X axis direction along the extension part 48 of the Y axis slider 10 when the X axis slider 7 moves in the X axis direction, and moves in the Y axis direction along the extension part 28 of the X axis slider 7 when the Y axis slider 10 moves in the Y axis direction. Therefore, the slider base 12 moves in an X-Y direction along with the movement of the X axis slider 7 and Y axis slider 10.

Figure 8:
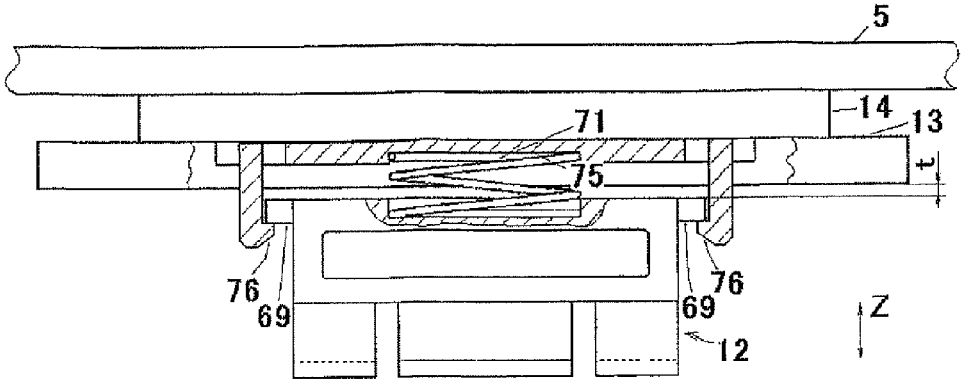
FIG. 8 is a side surface view of a partial cross section of the attaching state of the slider base to a table.

As is shown FIG. 8, the table body 13 includes a round shaped depression part 75 on the center section of the bottom surface, and a pair of claw parts 76 which project towards the bottom sandwiching the depression part 75. A pair of guard parts 69 of the slider base 12 are latched to the pair of claw parts 76 in the state where the upper end of the compression spring 71 is pressed against the inner bottom surface of the depression part 75 and the slider base 12 is thus fixed to the bottom surface of the table body 13.

As is shown in FIG. 8, a slight gap t is arranged between the top surface of the slider base 12 and the bottom surface of the table body 13. Therefore, the coil 14 (see FIG. 2, FIG. 9) attached to the top surface of the table body 13 can only move the distance of the gap t in a vertical direction, that is, Z axis direction in the diagram with respect to the slider base 12 against the compression spring 71. In the present embodiment, the gap t is about 0.3 mm but not limited to this.

The coil 14 moves in the X axis direction and Y axis direction while being press contacted with the bottom surface of the upper case 5. Although omitted from the diagram, it is possible to prevent the coil from abrasion by interposing a thin wafer etc between the coil 14 and the upper case 5.

Figure 9:
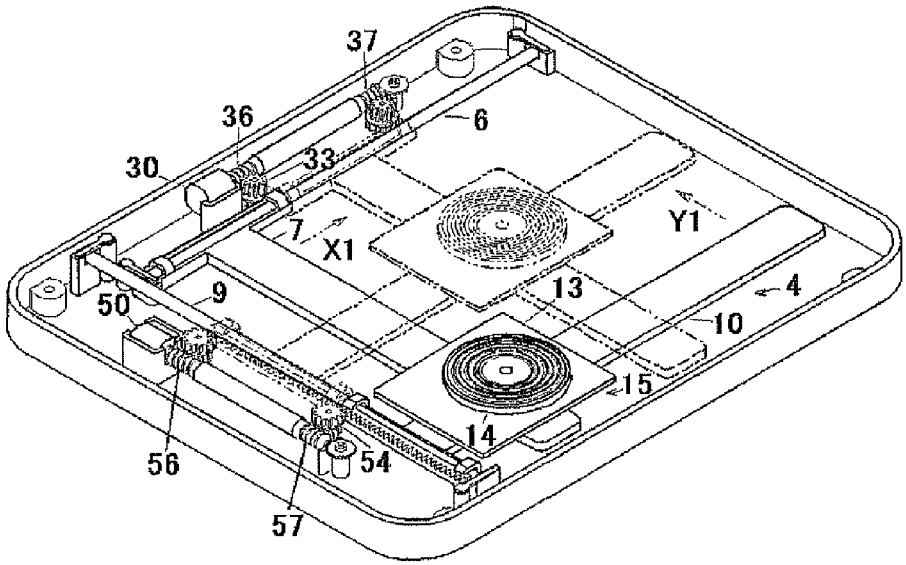
FIG. 9 is a perspective view diagram which shows a moving state of the table.

Next, the operation of the two dimensional moving mechanism is explained. FIG. 9 shows the state where the coil 14 (shown by the solid line) of the two dimensional moving mechanism 4 is located at a home position towards the front of the diagram. In this state, a detection means not shown in the diagram detects the charge battery 2 when the charge battery 2 is placed almost at the center of the device as in FIG. 1. Then, a control means not shown in the diagram drives he X axis motor 30 and Y axis motor 50 to move the coil 14 towards the position of the charge battery 2.

The power of the X axis motor 30 is transferred to the X axis slider 7 from the first worm gear 36 via the X axis pinion 33 and the slider 7 moves in the arrow X1 direction along the X axis guide 6. At the same time, the power of the Y axis motor 50 is transferred to the Y axis slider 10 from the second worm gear 57 via the Y axis pinion 54 and the slider 10 moves in the arrow Y1 direction along the Y axis guide 9.

Then, because the table 15 is located at an intersection part of the extension parts 28 of X axis slider 7 and the extension parts 48 of the Y axis slider 10, the coil 14 attached to the table 15 also moves along with the movement of the intersection part. In addition, when the coil 14 moves up to a certain position, the X axis motor 30 and Y axis motor 50 are stopped by the control means, power is transferred from the coil 14 to the charge battery 2 and the charge battery 2 begins to charge.

Figure 10A:
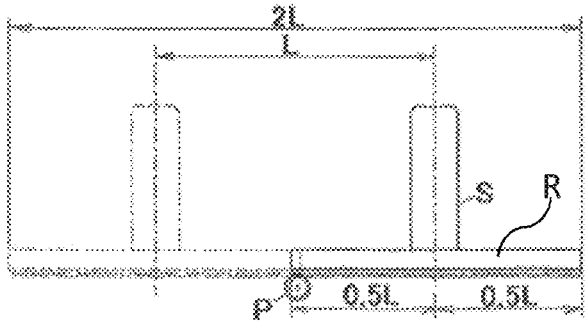
FIG. 10A is a diagram for explaining the effects of the present invention.
Figure 10B:
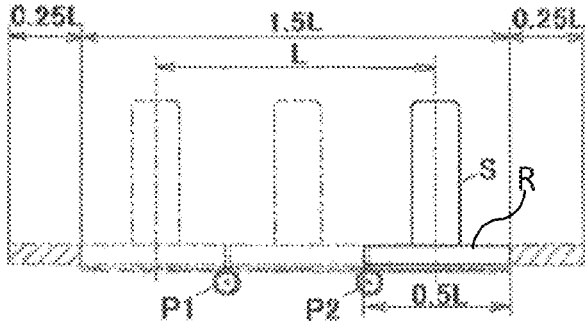
FIG. 10B is a diagram for explaining the effects of the present invention.

With the structure described above, it is possible to reduce the length of the racks 27, 47, to simplify the molding of the components, and to reduce the cost of manufacturing the components by arranging one pair each of the X axis pinions 33, 34 and the Y axis pinions 53, 54. And when the rack can be shortened, the mechanism itself can be miniaturized. These points are explained base on FIGS. 10A and B. FIG. 10A shows a structure whereby one pinion P is meshed the rack R arranged on the slider S, and FIG. 10B shows a structure of the present invention whereby two pinions P1, P2 are meshed to the rack R arranged on the slider S. In these structures, the slider S is only moved the same distance. Furthermore, while the case where the slider is moved in the X axis direction in FIGS. 10A and B, the same is also true when the slider S is moved in the Y axis direction.

In the structure of FIG. 10A where there is one pinion P, the rack R requires at least the same length as the moving distance of the slider in order to move the slider S the distance. In addition, the moving space of the rack R from the solid line position where the left end of the rack R meshes with the pinion P up to the virtual line position where the right end of the rack R meshes with the pinion P requires twice the length of the rack R, that is, 2L, and the dimensions of the mechanism itself in the X axis direction becomes at least 2L.

However, in the structure of the present invention shown in FIG. 10B, because the rack R is moved and passed from one pinion P1 to the other pinion P2, the length of the rack R is only half the moving distance of the slider S, that is, 0.5L, which is sufficient. In addition, because the sum of the moving distance of the slider S and the length 0.5L of the rack R, that is, 1.5L is sufficient for the moving space of the rack R, it is possible to reduce the dimensions of the mechanism itself in the X axis direction by 0.5L compared to the structure shown in FIG. 10A.

Figure 11A:
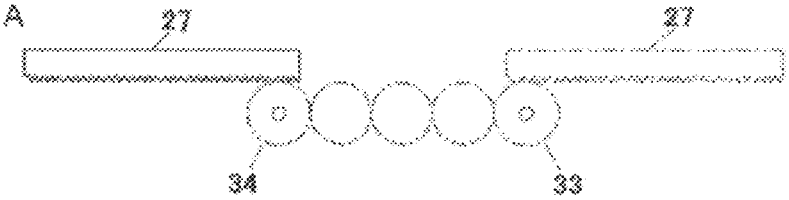
FIG. 11A is a diagram for explaining another embodiment of the present invention.
Figure 11B:
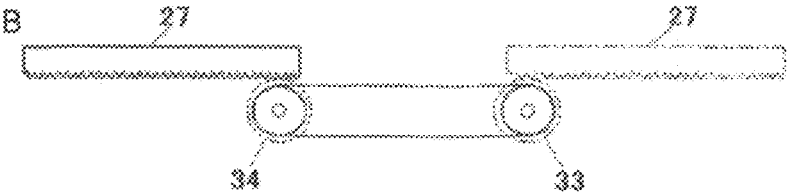
FIG. 11B is a diagram for explaining another embodiment of the present invention.

The structure of the present invention was explained above based on one embodiment. However, the present invention is not limited to this embodiment. For example, it is possible to insert an odd number of pinions or gears between a pair of pinions 33, 34 as is shown in FIG. 11A and transfer power of the motors to any one of these without transferring power from motors 30, 50 to pinions 33, 34, 53, 54 via the worm gears 32, 52, or as is shown in FIG. 11B, it is also possible to transfer power of the motors to one pinion by attaching a rubber belt between a pair of pulleys attached to a pair of pinions 33, 34.

The present invention is also not limited to the structures of the first drive mechanism 8 and second drive mechanism 11. For example, as is shown in FIG. 12, it is also possible to form a drive mechanism 106 as one unit in which a motor 100, a worm gear 102 which is directly connected to an axis 101 of the motor 100, and a pair of pinions 103, 104 which lie between a worm gear 102 and a rack 27 (not shown in F*ig*.12), are each connected to a metal bracket 105.

Furthermore, the pinions 103, 104 are arranged at a position to mesh with the teeth near both ends of the rack 27 of the slider 7 when the slider 7 (not shown in the diagram) is located at the center of the moving range the same as in the embodiment described above. Furthermore, for example, because each pair of pinions is meshed with respect to each rack and the pair of pinions are rotated in synchronization, it is possible to shorten the worm gear 102 even if the worm gear 102 is formed by cutting a metal round rod. Therefore, it is possible to manufacture the worm gear cheaply even if it is made from metal. In addition, it is possible to fix one part of the bracket 105 of the drive mechanism 106 to one part of the lower case 3 with a screw etc (not shown in the diagram).

By forming the drive mechanism 106 as one integral unit in this way, it is not necessary to directly attach each individual part such as a motor, a worm gear, pinions etc to the lower case 3, and it is effective to relax the parts dimensions accuracy of the lower case. Furthermore, because a motor is not directly attached to the lower case 3, it is possible to further obtain the effect whereby it becomes more difficult for the vibration of the motor to be transferred to the lower case 3. It is also possible to obtain the effect of being able to reduce drive noise when it becomes more difficult for vibration of the motor to be transferred to the lower case. Even if vibration of the motor is transferred to the lower case, because it is possible to insert a cushion material between the lower case and motor it is easier to control drive noise compared to attaching the motor directly to the lower case.

Figure 12:
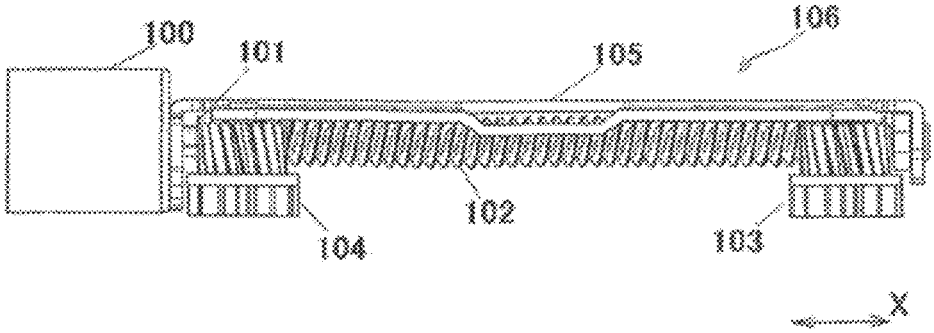
FIG. 12 is a side surface diagram which shows another embodiment related to a drive mechanism of the present invention.

FIG. 12 describes the drive mechanism using an X axis. However, because it is possible to use the present invention as a Y axis drive mechanism by reversing the vertical directions in the diagram, it is possible to integrate the components without requiring the manufacture of special parts for a X axis or Y axis.

What is claimed is:

1. A wireless charger installed with a moving part comprising:

a lower case, where a first coil is positioned; and an upper case which covers the lower case, the upper case comprising a top surface; and the moving part, wherein the first coil is moved near to a charge battery by the moving part and the charge battery is charged by supplying power from the first coil towards the charge battery when the charge battery attached with a second coil is set on the top surface of the upper case;

the moving part comprises:

a first drive part comprising an X axis motor which moves an X axis slider in an X axis direction along an X axis guide;

a second drive part comprising a Y axis motor which moves a Y axis slider in a Y axis direction along a Y axis guide; and a table which moves in the X axis direction and the Y axis direction by a movement of the X axis slider and the Y axis slider;

wherein the X axis slider includes a rack parallel to the X axis guide and an extension part parallel to Y axis;

the Y axis slider includes a rack parallel to the Y axis guide and an extension part parallel to X axis;

the table comprises;

a slider base attached to the X axis slider and the Y axis slider, and which moves in the X axis direction along the extension part of the Y axis slider when the X axis slider moves in the X axis direction, and moves in the Y axis direction along the extension part of the X axis slider when the Y axis slider moves in the Y axis direction; and a table body fixed to the slider base, and the first coil attached to a top surface of the table body;

the first drive part further comprises a pair of X axis pinions arranged at a location to simultaneously mesh with teeth near both ends of a rack of the X axis slider, and the pair of X axis pinions are driven by the X axis motor and rotated in synchronization when the X axis slider is located at the center of a moving range;

the second drive part further comprises a pair of Y axis pinions arranged at a location to simultaneously mesh with teeth near both ends of a rack of the Y axis slider, and the pair of Y axis pinions are driven by the Y axis motor and rotated in synchronization when the Y axis slider is located at the center of a moving range;

the slider base includes a hole passing through the slider base in an X axis direction and a plurality of L shaped leg parts arranged on a bottom of the slider base and projecting downward from the bottom of the slider base;

the hole is slidably attached to the extension part of the Y axis slider;

at least one of the plurality of L shaped leg parts is arranged to be opposed to the other L shaped leg parts; and the plurality of L shaped leg parts are slidably attached to the extension part of the X axis slider.

2. The wireless charger installed with the moving part according to claim 1, wherein each of the X axis pinions and the Y axis pinions is formed by a two stage gear, each pair of first stage gears of the X axis pinions and the Y axis pinions are meshed with the rack of the X axis slider or the Y axis slider, and the power of each of the X axis motor and the Y axis motor is transferred to each of the X axis pinions and the Y axis pinions via first worm gears including first worm and second worm which mesh with each pair of second stage gears of the X axis pinions and second worm gears including third worm and fourth worm which mesh with each pair of second stage gears of the Y axis pinions.

3. The wireless charger installed with the moving part according to claim 1, wherein the first drive part is formed as one integral unit in which the X axis motor which drives the X axis slider, first worm gears which are directly connected to an axis of the X axis motor and the pair of the X axis pinions which lies between the first worm gears and the rack of the X axis slider are each connected to a bracket.

4. The wireless charger installed with the moving part according to claim 3, wherein the worm gear is manufactured from metal.

5. The wireless charger installed with the moving part according to claim 1, Wherein each of the first drive part and the second drive part is formed as one integral unit in which the Y axis motor which drives the Y axis slider, second worm gears which are directly connected to an axis of the Y axis motor and the pair of the Y axis pinions which lies between the second worm gears and the rack of the Y axis slider are each connected to a bracket.

* * * * *